United States Patent [19]

Powell et al.

[11] 4,269,201

[45] May 26, 1981

[54] CIGARETTE WEIGHT CONTROL SYSTEMS

[75] Inventors: Gordon F. W. Powell; Reginald C. Bolt; Albert Simmons, all of London, England

[73] Assignee: Molins Limited, Great Britain

[21] Appl. No.: 890,816

[22] Filed: Mar. 27, 1978

[30] Foreign Application Priority Data

Mar. 31, 1977 [GB] United Kingdom ..... 13741/77

[51] Int. Cl.[3] ..... A24C 5/32; A24C 5/34

[52] U.S. Cl. ..... 131/280; 131/907

[58] Field of Search ..... 250/250, 358, 360, 308, 250/359; 364/552, 468, 469, 119; 131/21 R, 84 R, 21 B, 23 R, 22 R; 235/151.1, 151.13, 151, 150.1

[56] References Cited

U.S. PATENT DOCUMENTS

| | | | |
|---|---|---|---|
| 3,829,695 | 8/1974 | Powell | 131/21 B |
| 3,878,982 | 4/1975 | Hoffmann | 131/22 R |

*Primary Examiner*—V. Millin

*Attorney, Agent, or Firm*—Craig and Antonelli

[57] ABSTRACT

Checking system for the scanner station of the nucleonic rod-weight control system of a continuous rod cigarette making machine, in which a stable voltage reference is switched into the circuit in place of the usual ionization chamber balance unit and a measurement is made of the difference between the reference voltage and the scanner station radiation reading while no cigarette rod is present, to determine whether the scanner station is free of debris etc. The system opens the internal shutter of the radiation source to enable the measurement to be made and closes the entrance to the scanner unit to prevent escape of B-particles. The reading circuit includes a sample-and-hold facility which enables the reading to be stored so that it can be subsequently read out by an operator or supplied to a centralized computer control system.

11 Claims, 7 Drawing Figures

RLI-1
RLI-2
RLI-3
RLI-4
+15V
BFX 85
4Y
10K
2.2K
IN4148
B1
B2
22K
-15V
SET HEAVY LIMIT
SET LIGHT LIMIT
26
47K
5K
A3
5.1K
IN4148
10K
6
A2
A4
10
UP/DOWN
16
4.7K
280Ω
18
10D4
B3
B4
D
E
F
G
8
1μF
390K
A1
2
4
3.3K
1K
680
BZY 88C10
8 BIT OUTPUT TO GATES
J
H
22
28
30
C1
C2
C3
C4
14,20
820K
4.7μF
24
12

CIGARETTE WEIGHT CONTROL SYSTEMS

This invention relates to cigarette-making machinery and particularly to systems including nucleonic devices for monitoring the weight of a continuous wrapped rod of tobacco formed by a cigarette-making machine. One existing device of this type utilizes a scanner unit which passes beta-rays from a primary radiation source through the rod.

The degree to which the rays are absorbed is measured by comparing the output from a detector positioned on the opposite side of the rod from the source, with the output from a detector facing another smaller source (the "balance unit") whose output is preset so that when the rod weight is correct the detected outputs from the two sources will be equal. Any out-of-balance effect is a measure of the degree to which the rod is over-or under-weight.

At the scanning station the rod passes through a guide which has a "window" which is transparent to beta-rays and it is essential that the scanning station is kept clean since any dust or debris present would be included by the scanner in the weight reading, during use, so that the cigarettes subsequently manufactured would tend to be underweight. It is therefore desirable to be able to check the condition of the scanning station before the making machine is started up, and for this purpose an artificial cigarette of known weight may be provided, which the operator can insert into the entrance of the scanning station and which acts as a calibration check. The artificial cigarette is adapted to open an internal safety shutter which normally shuts off the radio-active source when the cigarette rod is absent. However these devices are not always used by operators as regularly as is desirable because they can be awkward to use depending on the machine layout, and they may not produce completely consistent results if not used carefully.

According to one aspect of the invention, therefore, there is provided a scanning station checking system for a cigarette making machine of the type described, comprising a test circuit connected to the scanner head, the test circuit being arranged to operate control means to open the shutter over the radioactive source when the test is initiated, to activate a warning device if the reading produced by the scanner head is beyond a predetermined limit or limits, and preferably to then close the shutter automatically.

Preferably the checking system includes a reference voltage circuit which is adapted to be connected in place of the "balance unit" and which can provide an output sufficiently large to balance the output of the primary source even when no cigarette rod is present in the scanning station, so that a null reading can be obtained by comparing the signal detected from the primary source with a signal derived from the voltage reference.

The test circuit may also be arranged to prevent the making machine from coming into operation if a satisfactory test reading is not obtained, for example by operating a relay to shut off the power supply. The test circuit may also incorporate a sample-and-hold facility so that the operator, or an external data-processing system, can be supplied with the reading at a later time. According to a further aspect of the invention, therefore, a testing circuit for a scanner unit of the type described comprises a comparator having a first input connected to the scanner head and having its output connected to an up-down counter; a digital-to-analogue converter having its input connected to the up-down counter and its output connected to a second input of the comparator and to a center zero meter or a digital indicator; and circuit-setting means adapted to initiate operation of the circuit by setting the contents of the counter to a predetermined initial value and starting the counter. The way in which this arrangement provides a sample-and-hold facility will be explained in detail below. Preferably the first input of the comparator is connected to the scanner unit via an integrator comprising an amplifier having a parallel capacitor which is of suitable size to provide smoothing of any noise present in the scanner signal. In this case the circuit-setting means will include a delay circuit which provides a sufficient time delay before starting the count to enable the output from the integrator to reach about 99% of the actual signal value.

Since the opening of the shutter would otherwise allow a stream of beta particles to issue from the end of the rod guide, where the rod normally enters the scanner, an external shield must be arranged to close the end whenever the internal shutter is opened in the absence of the cigarette rod. According to a further aspect of the invention there is provided a spring-loaded shield member which is biased to a position in which it closes the opening at the entry end of the rod guide of the scanner unit, and which is arranged to be moved to an open position when the rod is to be passed through the scanner, i.e. when the start-up cycle of the rod-making machine has been completed.

The type of machine with which the shield device is intended to be used employs a "rod break-in" mechanism which operates on start-up of the machine, including a deflector which allows the rod to pass into the scanner unit only when it is of satisfactory quality to be used to make cigarettes. At other times the rod is deflected so that it goes to waste. Thus according to a further aspect of the invention the movement of the deflector may be utilized to actuate the shield device.

Preferably, the shield device comprises a plate pivotally mounted on the machine so as to overlie the entry to the scanner, and having an aperture which can be moved into register with the entry to the scanner by pivoting movement of the plate, co-operating means being provided on the shield device and the deflector to urge the shield, against the action of the spring loading, to the position in which the aperture registers with the opening when the deflector has moved to an inoperative position. The making machine also incorporates a heater device which moves into contact with the wrapped rod to seal it after the machine has started up, and the movement of this device may alternatively be utilized to actuate the shield.

Some embodiments of the invention will now be described by way of example with reference to the accompanying drawings, in which.

Figure 1:
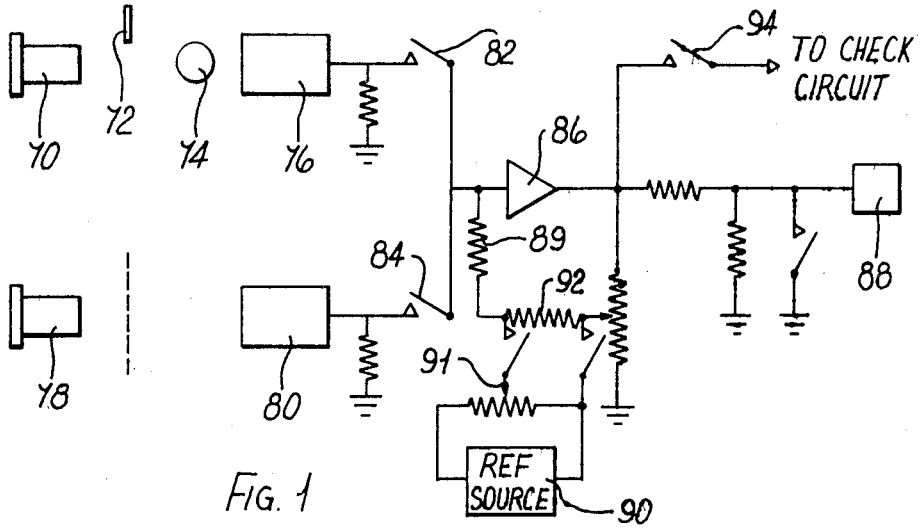
FIG. 1 is a schematic diagram of a weight control system.

As shown in FIG. 1 the weight control system comprises a primary beta-particle source 70 which is covered by a safety shutter 72 when the cigarette rod 74 is absent from the unit. In normal operation, when the rod is present, a detector cell 76 receives those beta-particles emitted by the source which are not absorbed by the rod and the current produced by these particles is compared to the current produced by the stream of particles from a "balance unit" source 78 falling on a detector 80. This comparison is carried out, when the switches 82 and 84 are closed, in an amplifier 86 whose output is displayed on the meter 88.

It is essential to ensure the maximum possible stability of the system, and to avoid any "drift," since a 1% change in the weight reading would indicate a quite unacceptable variation in the product weight. The input impedance of the amplifier 86 is therefore constituted by a very high value ultra-stable resistor 89. This may for example be a "VICTOREEN SLIM-MOX" type 204 resistor having a value of $2.5\times10^{9}\Omega$.

When an initial check of the system is to be carried out before sealed rod manufacture is commenced, the sequence of operation is controlled by the checking circuit, FIG. 2, in the following way: The operator of the making machine starts it up as usual at low speed. This action also closes a contact 12 (which may be replaced by, or in parallel with, a manual push-button). Meanwhile the unsealed wrapped rod is being deflected to waste so that it does not enter the scanner unit.

When the switch 12 is closed, a monostable 14 applies a pulse of 0.5 second duration to an up-down counter 10 and presets it to a half-full state. The pulse is also applied to one input of an OR-gate 16 which operates a relay 18. This opens the scanner source shutter 72 (FIG. 1) closes switch 82 connecting detector 76 to amplifier 86, and also connects a highly stabilized reference voltage source 90 across the feedback resistor 92 of the amplifier 86. The resistor 92 has a negligibly low value compared to that of the resistor 89, and the impedance of the source 90 is also very low, so that no significant voltage is developed across them. The voltage applied across resistor 92 by the source 90 is adjusted by means of the potentiometer 91 so that it will just balance the voltage produced across the resistor 89 by the current from detector 76, when the scanning station is "clean."

A switch 94 is also closed by relay 18 to connect the output of the amplifier 86 to an amplifier 2 (FIG. 2), having a capacitor 4 connected across it to smooth out undesirable variations (such as noise) in the input signal. The size of the capacitor is chosen to provide a time constant of 400 ms. in the example shown, so that the output settles down to its final value after about 2 seconds.

The output of amplifier 2 is supplied to the inverting input of a comparator 6 whose non-inverting input is connected to the output of a digital-to-analogue converter 8 so that the output of the comparator at any instant depends upon the difference between the output of the converter and the output of amplifier 2. The output of comparator 6 is supplied to the 8-bit-up-down counter 10 connected to the D.A.C. 8.

The 0.5 second pulse also triggers another monostable 20 which applies a pulse of 2 seconds duration to a 1 Khz clock pulse generator 22 feeding the clock input of the 8-bit counter 10, so that the circuit is activated for a sufficient period for the output reading to stabilize.

In operation, assuming some debris is present in the scanner, when the source shutter has been opened and the count started, the difference between the initial small positive output of the amplifier 2, and the Ov output of the D.A.C. 8 causes a "0," to appear at the output of the comparator 6, which is fed to the counter 10 and causes it to count downwards at the clock frequency of 1 Khz so that the output of the D.A.C. rises. This output is fed back to the non-inverting input of comparator 6 so that this input receives a signal which is increasing in a positive direction towards the value of the signal from amplifier 2. When it passes the instantaneous value of the signal at the inverting input (i.e. becomes more positive than that signal) the output of comparator 6 switches to "1" causing the counter to count upwards so that the output from the D.A.C. will then fall.

In this way the circuit "hunts" for the equilibrium value of the scanner head reading and stores it in the counter, the reading being shown and held in the analogue form on a meter 24 driven by the D.A.C. 8. Upper and lower limits are preset in a limit alarm circuit 26 which operates the alarm and/or prevents the cigarette making machine from operating if they are exceeded. Since the reading is retained on the meter and in the counter it can be fed to a central computer for management information or other purposes, whenever the computer interrogates the system for information.

If the scanner head produces a very large signal for any reason, the counter will rapidly reach the "all ones" (full) condition or the "all zeros" (empty) condition. Because of its internal construction it immediately reverts to "empty" when it has counted up to the "full" condition and similarly it reverts to "full" when it has counted down to "empty." Thus if such an extreme condition were reached without this reversion being prevented, the reading of the meter would oscillate rapidly between maximum and minimum and would stop in a random position whenever the timed two second period elapsed. To avoid this happening, therefore, an eight-input "AND" gate 28 is connected to the output lines of the counter, which is arranged to detect the "all ones" condition and in this event, to reset the monostable 20 and thus stop the counter. In parallel with this is an eight-input "OR" gate 30 which similarly resets the monostable in the event of "all zeros" being detected.

Figure 2:
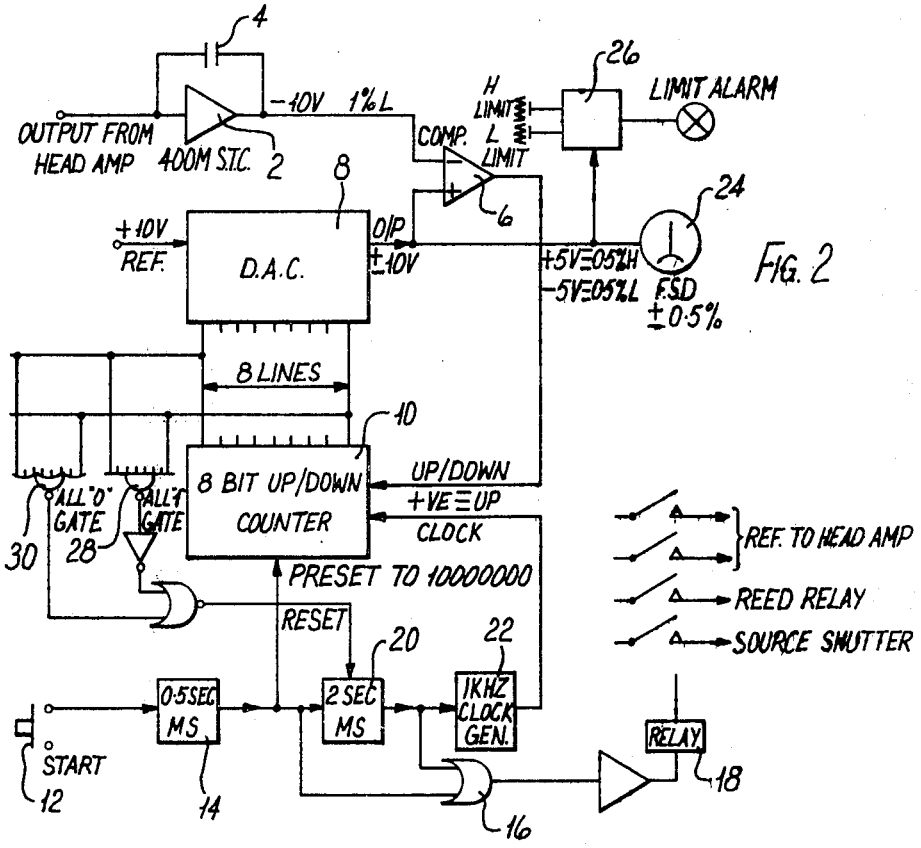
FIG. 2 is a block diagram of a weight control system checking circuit.
Figure 3:
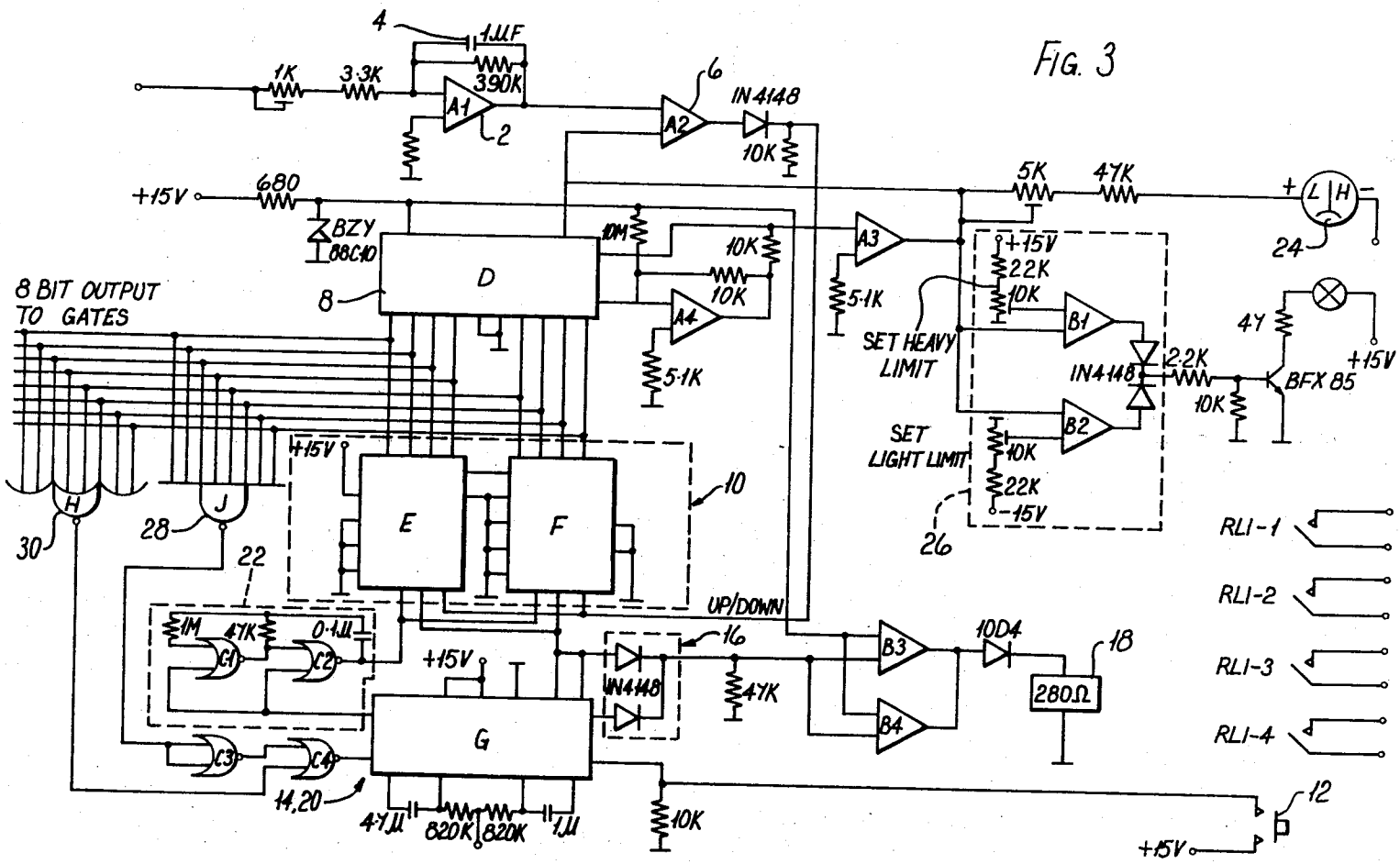
FIG. 3 is a detailed circuit diagram corresponding to FIG. 2.

FIG. 3 shows a practical circuit corresponding to the amplified block diagram of FIG. 2, the main circuit blocks being referenced correspondingly to those in FIG. 2.

The main components of the circuit shown by way of example in FIG. 3 are as follows:

Amplifiers "A," "B": LM 324
Gates "C": MC 14001
Digital-to-analogue converter "D": AD 7520
Counters "E," "F": MC 14516
Timers "G": MC 14528
Gate "H": HEF 4078
Gate "J": HEF 4068

As an alternative to the above "sample-and-hold" type of circuit described with reference to FIGS. 2 and 3, a simple checking system may be provided in the arrangement of FIG. 1 by means of a push-button which operates a relay which closes contact 82 while holding contact 84 open, and also connects the voltage reference source 90 across feed-back resistor 92 of the amplifier 86. This enables direct reading, which should of course be a null, to be obtained on meter 88.

Figure 5:
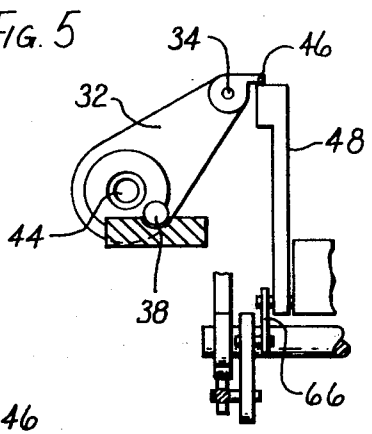
FIG. 5 is an end view of the device of FIG. 4.
Figure 7:
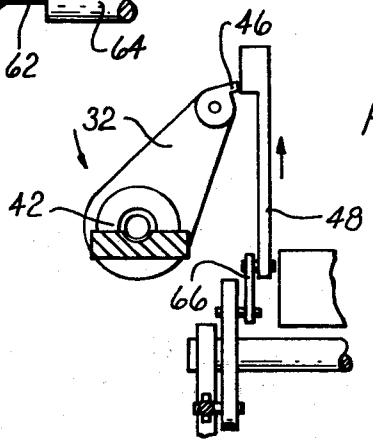
FIG. 7 is a view corresponding to that of FIG. 5 but showing the device in the open position.
Figure 4:
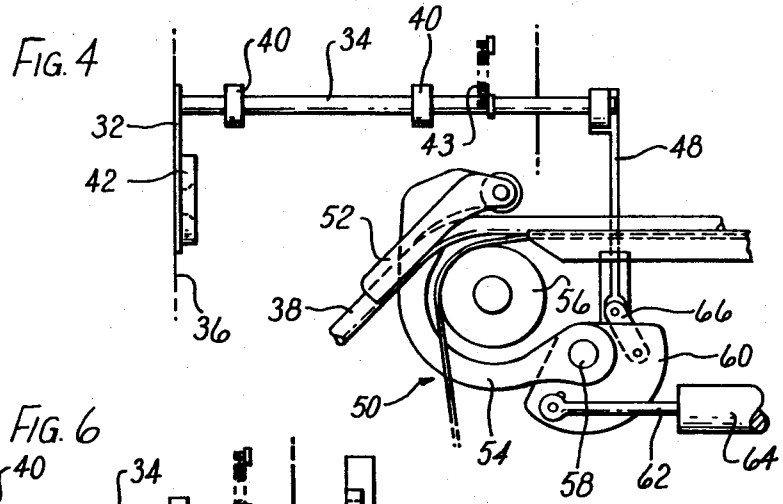
FIG. 4 is a side view of a beta-particle shield device in the closed position.
Figure 6:
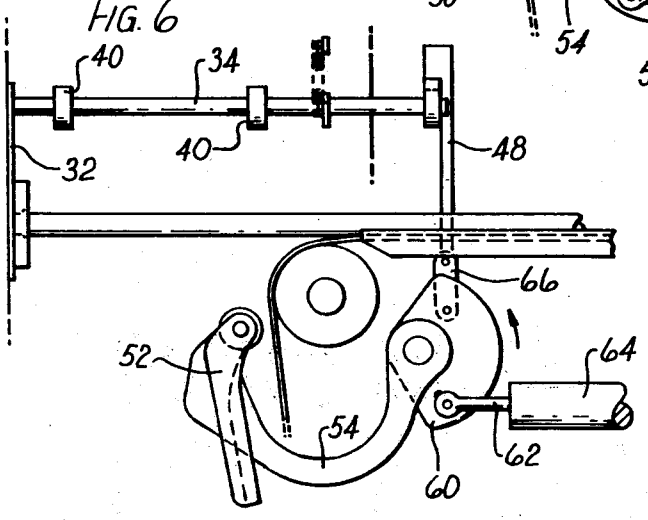
FIG. 6 is a view corresponding to that of FIG. 4 but showing the device in the open position.

FIGS. 4 to 7 show a spring-loaded shield member which is linked to the rod break-in device, and which is arranged to close the entrance to the scanner unit while the condition of the scanning station is being checked, to prevent beta particles from being emitted from the unit. Referring first to FIGS. 4 to 5 in which the shield device is shown in the closed position, the shield comprises a plate 32 mounted on one end of a spindle 34 whose axis is arranged parallel to the normal direction of travel of the cigarette rod through the making machine and the scanner unit 36. The plane of the plate 32 thus intersects the path of the rod into the scanner (shown by dashed lines 38 in FIG. 4).

The spindle is rotatably mounted in bushings 40 on the frame of the making machine, and is resiliently biassed, by means of a spring 42 in a clockwise direction as seen in FIG. 5 towards a stop (not shown) which is positioned so that the plate 32 occupies the position shown in FIG. 4. In this position an aperture 44 in the plate is kept out of register with the entrance of the scanner unit, which is of course aligned with the normal path 38 of the cigarette rod, so that the entrance is closed by the plate.

The other end of the spindle carries a generally radially-extending lug 46 which is engaged by a vertically movable push rod 48. The push rod is linked at its lower end to the operating mechanism of a rod-break-in and deflecting device 50 which operates in the following way: When the cigarette-making machine is started up, the wrapped rod which issues from it is not at first of suitable quality for making cigarettes. A deflector member 52 is therefore initially held in the position indicated in FIG. 4, so as to deflect the rod to waste in the direction of arrow A. The deflector 52 is mounted on one end of a curved arm 54 which extends around a pulley 56 carrying the rod transport belt. The other end of the arm 54 is pivoted at 58 to the frame of the making machine and is fixed to a sector-shaped member 60, which is connected by means of a connecting-rod 62 to an air-cylinder 64. The lower end of the push rod 48 is connected to the sector-shaped member 60 by means of a link 66.

While the rod is being deflected as shown in FIG. 4, the shield is in the closed position, with the push rod 48 occupying its lowermost position, so that the scanner unit check can be carried out. When the check has been completed and the rod quality is also satisfactory, the air cylinder 64 is actuated retracting the connecting rod 62 and so rotating the sector-shaped member 60 to the position shown in FIG. 6. This action urges the link 66 and push rod 48 upwardly, rotating the lug 46 and thus the spindle 34 and plate 32 to the position shown in FIG. 7 so that the aperture 42 in the plate registers with the entrance to the scanner unit.

At the same time the curved arm 54 is drawn downwardly by the rotation of the sector-shaped member 54, and a steel roller 68 at the end of the deflector bends the rod tightly around the pulley 56 thus breaking off the rod. The newly-broken end is then able to pass through the aperture 42 of the plate 32 and into the scanner unit 36.

As shown the shield member is operated by the same pneumatic actuator as the "rod break-in" device. As an alternative separate actuators may be provided. The checking circuit and the actuators may also be interlocked to ensure that the shield member is in the closed position whenever the checking circuit is actuated.

We claim:

1. A cigarette weight control system for a continuous-rod cigarette-making machine having a rod guide, said system including a radiation source and a radiation detector positioned on mutually-opposite sides of said rod-guide, shutter means including a shutter for covering the radiation source when no rod or other beta-ray absorbing member is present in the guide, and a test circuit comprising control means connected to the said shutter means for selectively opening the shutter when no rod is present in the guide, signal level detection means connected to the signal output of the radiation detector for producing a test signal representing the radiation level of radiation passing through the guide in the absence of the rod or other beta-ray absorbing member, and means for actuating a warning device if the signal level of said signal is outside of a predetermined range.

2. A cigarette weight control system according to claim 1, further comprising a sample-and-hold circuit for storing the measured test signal.

3. A cigarette weight control system according to claim 2 further comprising means for automatically closing the shutter on completion of the test.

4. A cigarette weight control system according to claim 1 further comprising a reference voltage source which is arranged to provide a reference voltage for comparison with the test signal voltage.

5. A cigarette weight control system according to claim 1 further comprising control means for actuating the test circuit when the making machine is switched on and to prevent the making machine from coming into normal operation in the absence of a satisfactory test signal.

6. A cigarette weight control system according to claim 1, further comprising a beta-ray shield device including a spring-loaded closure member at the entry to the rod guide of the scanner unit, which is biassed to the closed position and means responsive to said control means for moving said closure member to the open position when the cigarette-making machine starts up.

7. A cigarette weight control system according to claim 1, including also a beta-ray shield device mounted for movement between a first position in which it closes the rod inlet of the rod guide, thereby preventing or reducing the passage of beta-rays through said rod inlet while permitting beta-rays to pass to said radiation detector, and a second position at which it is clear of the inlet.

8. A cigarette weight control system according to claim 7, including means for automatically deflecting the cigarette rod away from the rod inlet when the cigarette-making machine begins to operate, and control means whereby the beta-ray shield device remains in its first position as long as the cigarette rod is being so deflected, and whereby the shield device is moved to its second position when the rod deflecting means is displaced to permit the rod to enter the inlet.

9. A cigarette weight control system according to claim 8, in which said control means includes a mechanical link between the beta-ray shield device and the rod deflecting means.

10. A cigarette weight control system for a continuous-rod cigarette-making machine having a guide, said system including a radiation source and a radiation detector positioned on mutually-opposite sides of said rod-guide, shutter means including a shutter for covering the radiation source when no rod is present in the guide, and a test circuit comprising control means connected to the said shutter means for selectively opening the shutter when no rod is present in the guide, signal level detection means connected to the signal output of the radiation detector for producing a test signal representing the radiation level of radiation passing throught the guide in the absence of the rod, and means for actuating a warning device if the signal level of said signal is outside of a predetermined range, said signal level detection means comprising a comparator having a first input connected to receive the output of said radiation detector and having its output connected to an up-down counter; a digital-to-analogue converter having its input connected to the output of the up-down counter and its output connected to a second input of the comparator and to an indicating device; and circuit-setting means adapted to initiate operation of the circuit by setting the contents of the counter to a predetermined initial value and starting the counter, whereby the comparator drives the counter until the output from the digital-to-analogue converter is equal to the output received from the radiation detector.

11. A cigarette weight control system according to claim 10 which further comprises an integrator connected between the output of the radiation detector and the first input of the comparator, and in which the circuit-setting means includes a delay circuit arranged to provide a suitable delay before actuation of the counter, to enable the output of the integrator to stabilize.

* * * * *